US005730624A

United States Patent [19]

Lester et al.

[11] Patent Number: 5,730,624

[45] Date of Patent: Mar. 24, 1998

[54] SECONDARY CONTACT LOCK ARRANGEMENT

[75] Inventors: Lester Joaquin Lester, Signal Hill; Gary Neil Van Trump, Santa Ana, both of Calif.

[73] Assignee: ITT Corporation, New York, N.Y.

[21] Appl. No.: 565,515

[22] Filed: Nov. 30, 1995

[51] Int. Cl.[6] ..... H01R 13/40

[52] U.S. Cl. ..... 439/595

[58] Field of Search ..... 439/595, 752, 439/587

[56] References Cited

U.S. PATENT DOCUMENTS

| | | | |
|---|---|---|---|
| 3,838,382 | 9/1974 | Sugar | 439/595 OR |
| 3,937,545 | 2/1976 | Cairns et al. . | |
| 3,971,613 | 7/1976 | Kobler . | |
| 4,544,220 | 10/1985 | Afello et al. . | |
| 4,557,542 | 12/1985 | Coller et al. . | |
| 4,565,416 | 1/1986 | Rudy et al. . | |
| 4,602,837 | 7/1986 | Sian et al. . | |
| 4,698,030 | 10/1987 | Ryll et al. | 439/752 OR |
| 4,714,437 | 12/1987 | Dyki | 439/595 |
| 4,749,372 | 6/1988 | Betsui | 439/587 |
| 4,749,373 | 6/1988 | Brekosky et al. | 439/595 OR |
| 4,776,813 | 10/1988 | Wilson et al. | 439/587 |
| 4,826,452 | 5/1989 | Sian et al. | 439/595 |
| 4,902,247 | 2/1990 | Suzuki et al. | 439/595 |
| 4,936,798 | 6/1990 | Hass et al. | 439/752 |
| 4,944,695 | 7/1990 | Tsuji et al. | 439/595 |
| 4,963,106 | 10/1990 | Wendling et al. | 439/595 |
| 4,973,268 | 11/1990 | Smith et al. | 439/595 |
| 5,071,369 | 12/1991 | Denlinger et al. | 439/595 |
| 5,135,416 | 8/1992 | Hass et al. | 439/752 |
| 5,273,443 | 12/1993 | Frantz et al. | 439/595 |
| 5,496,194 | 3/1996 | Huss, Jr. | 439/595 OR |

*Primary Examiner*—P. Austin Bradley
*Assistant Examiner*—Daniel Wittels
*Attorney, Agent, or Firm*—Freilich Hornbaker Rosen

[57] ABSTRACT

A secondary lock is provided to prevent deflection of a tine and therefore prevent loss of a contact, which can be used in miniature connectors having a large number of contacts and corresponding miniature tines. A first tine (71, FIG. 6 ) at each contact-receiving passage (20) of the connector, has a substantially straight inner tine side (82) extending forwardly and with a radially inward directional component, and has an outer tine side (84) with a forward surface portion (86 A) that extends substantially parallel to, the axis of the passage. The secondary lock includes a post (24) that is slidable parallel to the contact-receiving passage and that has a blocking surface (90) that lies close to, but slightly spaced from the forward surface portion of the outer tine side. The forward surface portion (86A) extends forwardly about as far as contact-abutting ends (64, 65) of the tines. The contact-receiving passages are arranged in two concentric circles (21, 23 FIG. 4), with a post-receiving hole (30A) engaging tines at passages lying at each circle. Each post has long ribs (14, FIG. 12 ) to lightly hold the secondary lock in place during shipment, and has short ribs (142) to secure the secondary lock in place after the contacts are installed.

15 Claims, 4 Drawing Sheets

SECONDARY CONTACT LOCK ARRANGEMENT

BACKGROUND OF THE INVENTION

Electrical contacts are commonly retained in contact-receiving passages of a connector insulator by resilient tines. A connector is pushed forwardly into a connector-receiving passage, and radially outwardly deflects tines lying around that passage when a shoulder on the contact passes the tines. The tines then snap to a position behind the shoulder, thereby preventing rearward removal of the contact. A secondary lock can be provided to prevent at least one tine at each contact-receiving passage, from deflecting radially outwardly. This prevents inadvertent contact rearward movement, as during mating of the connector with another one. Where a large number of contacts must be retained in a connector of small size, it can be difficult to provide a secondary lock for a tine at each contact passage. A secondary lock which could be constructed at relatively low cost, which provided reliable secondary locking of a tine, and which could be readily used to hold a tine at each of many contact-receiving passages, would be of value.

SUMMARY OF THE INVENTION

In accordance with one embodiment of the present invention, a connector is provided with a secondary lock of relatively simple and reliable construction. The connector has contact-receiving passages that may be arranged in concentric circles, and has tines that surround the passages. Each tine has a free abutting end that lies in line with a contact shoulder to prevent withdrawal of an installed contact. A first tine at each contact-receiving passage, has a radially outer tine side with a forward portion that extends about as far forward as the tine abutting ends. The forward portion outerside preferably extends substantially parallel to the passage axis. The secondary lock includes a post that is slidable substantially parallel to the passage axis and that has a blocking part lying adjacent to but slightly spaced from the outer side of the first tine. The post prevents the first tine from deflecting radially outwardly sufficiently to allow removal of the contact.

The secondary lock includes a largely plate-like holder and a plurality of cylindrical posts that each projects into a corresponding post-receiving hole in the connector insulator. Each post has a pair of ribs, including a longer rib which first enters a post-receiving hole, and a shorter rib. The posts are first partially installed, with each longer rib lying in a post-receiving hole in a moderate interference fit therewith that keeps the secondary lock in place during transport to a customer. A customer inserts the electrical contacts, and then pushes the secondary lock firmly into place, thereby also inserting the shorter ribs into the post-receiving holes to provide a larger interference fit of each post in a hole.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
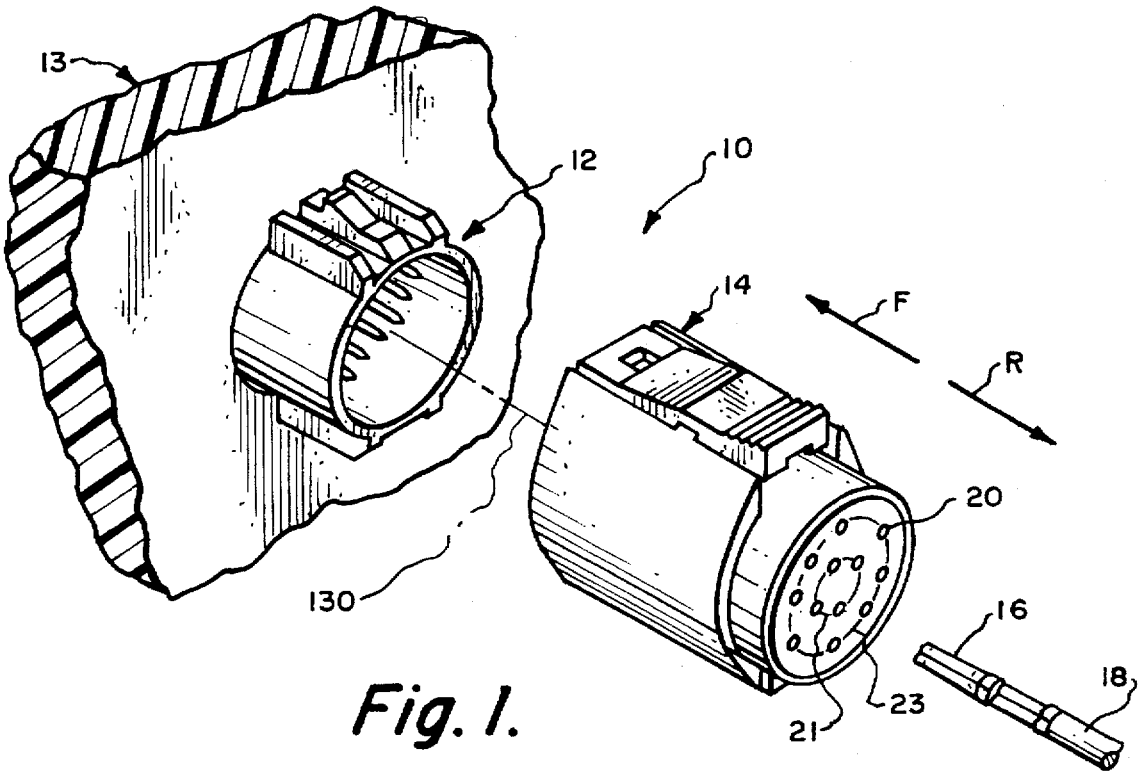
FIG. 1 is an exploded isometric view of a connector system constructed in accordance with the present invention, and showing the rear end of the plug connector.

FIG. 1 illustrates a connector system 10 which includes a receptacle connector 12 mounted on a wall 13 such as the transmission casing of a vehicle, and a plug connector 14 which can be mated to the receptacle connector by moving the plug connector in a forward direction F. The figure also shows an electrical contact 16 which is crimped to the front end of an insulated wire 18, the contact being installable in contact-receiving passages 20 of the plug connector 14. The passages are arranged along two concentric circles 21, 23 that are concentric with the axis 130 of the plug connector.

Figure 2:
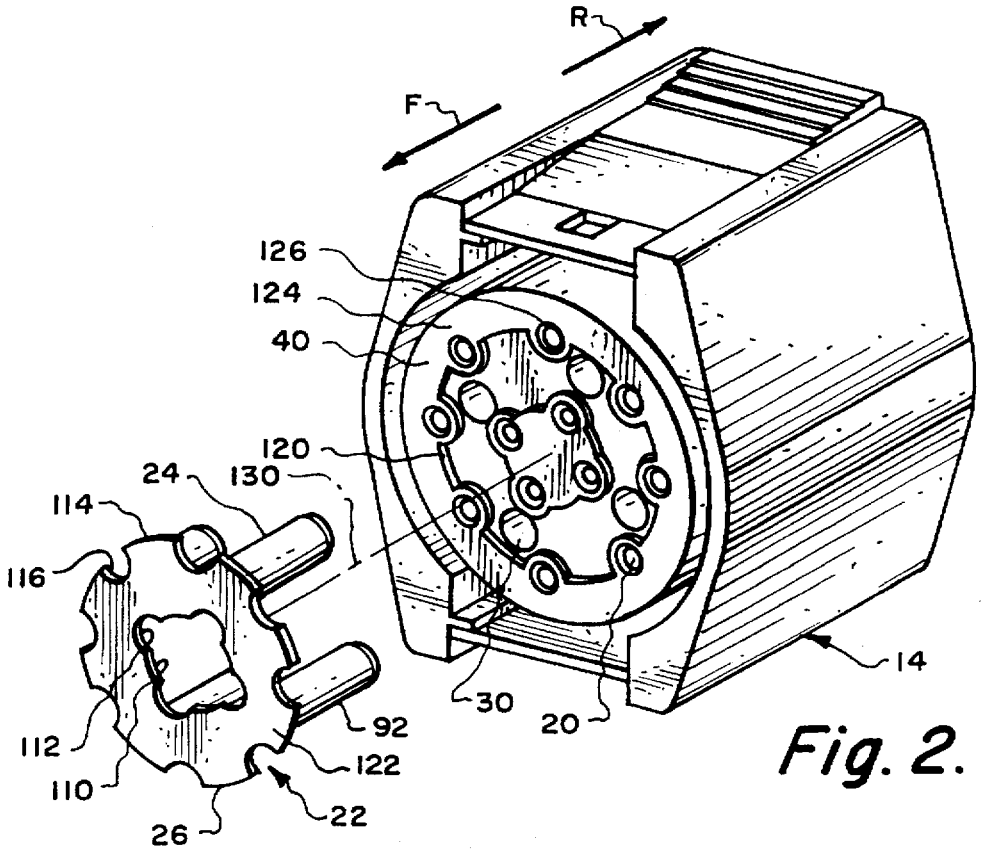
FIG. 2 is an exploded front isometric view of the plug connector of FIG. 1, with the secondary lock not yet installed.

FIG. 2 shows the front and sides of the plug connector 14, and shows a secondary lock 22 that can be moved in a rearward direction R into the connector. As the secondary lock moves rearwardly, posts 24 held by a plate-like holder 26 can enter post-receiving holes 30 of the connector. The particular connector shown has twelve contact-receiving passages 20, with four spaced along the inner circle 21 and with eight spaced along the outer circle 23. The secondary lock has four posts 24, with each post being associated with three of the passages 20, including one on the inner circle and two on the outer circle, to lock three corresponding contacts in the passages.

Figure 3:
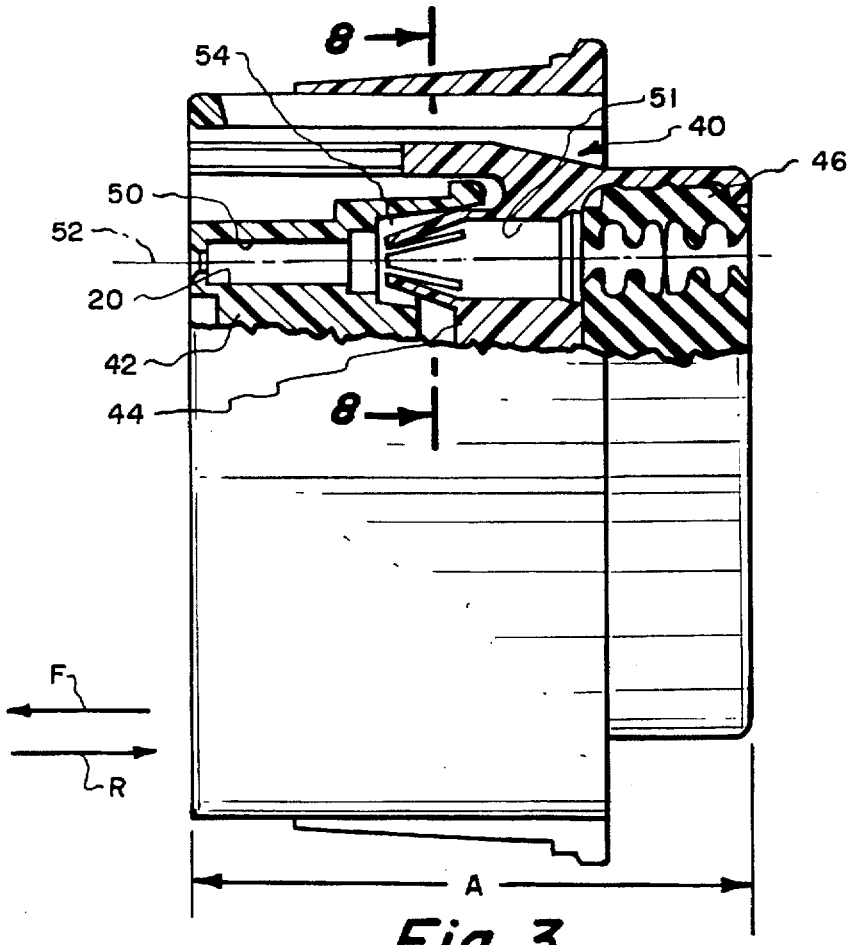
FIG. 3 is a sectional view of the connector of FIG. 2, shown prior to installation of the electrical contacts in the secondary lock.

FIG. 3 shows the overall construction of the connector, prior to installation of the contacts and the secondary lock, but with some fluid seals not shown. The connector includes an insulator 40 that has front and rear insulator members 42, 44 that are each preferably constructed of an engineering plastic (a Young's Modulus of Elasticity of at least 50K psi). A grommet 46 of soft rubber or other elastomeric material lies behind the rear insulator member. The insulator forms the contact-receiving passages 20 that are each designed to receive an electrical contact by inserting the contact in a forward direction F along the axis 52 of the passage. Each insulator member has a passage portion 50, 51 that forms part of each passage 20. The connector includes a set 54 of tines at each passage, to prevent rearward removal of an installed contact. For the particular connector shown, the tines 54 are molded as part of the rear insulator member 44, although it is possible to form the tines on a separate member. The connector includes stakes (not shown) that hold the front and rear insulator members together.

Figure 4:
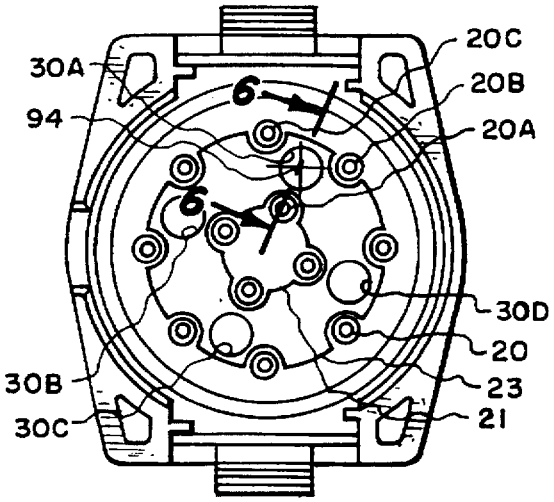
FIG. 4 is a front elevation view of the connector of FIG. 3.
Figure 5:
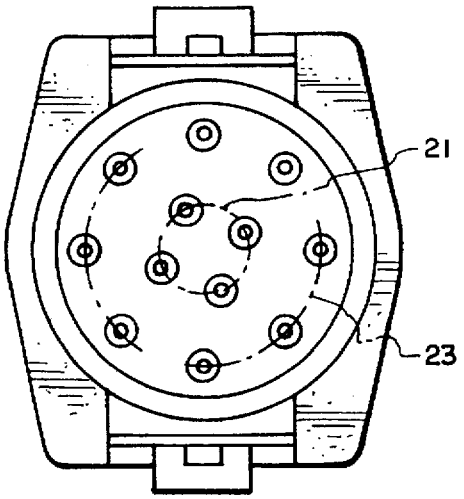
FIG. 5 is a rear elevation view of the connector of FIG. 3.
Figure 6:
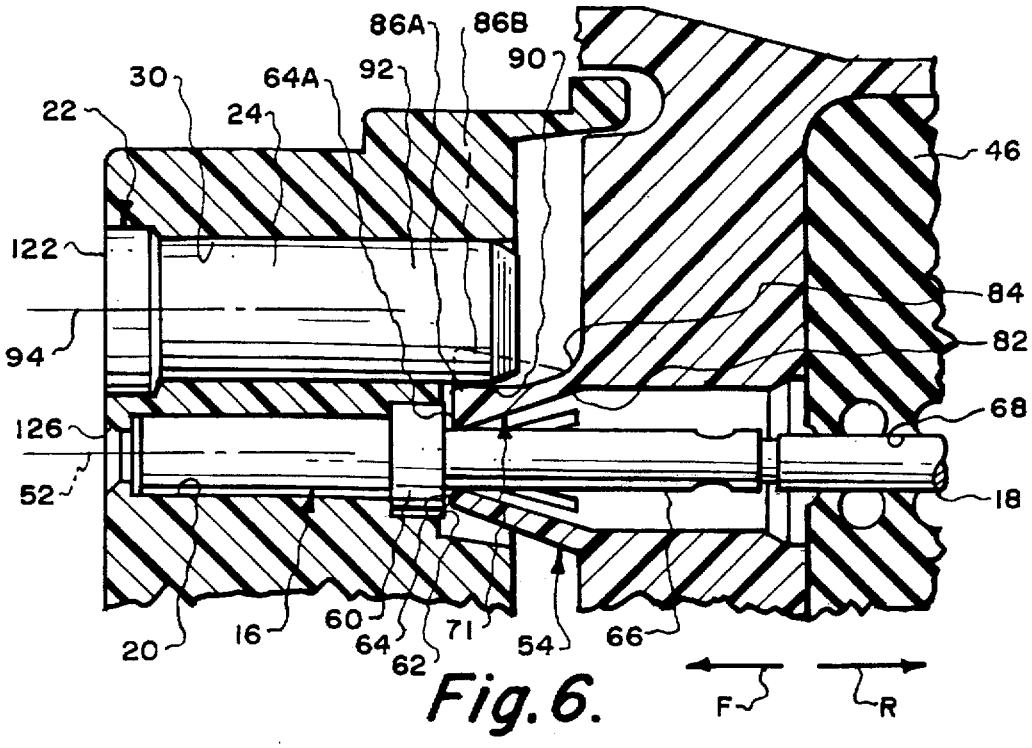
FIG. 6 is a partial sectional view taken on line 6—6 of FIG. 4, but with the electrical contacts and secondary lock in fully installed positions.

FIG. 6 is a view taken on line 6—6 of FIG. 4, showing a socket electrical connector 16 in a fully installed position in a contact-receiving passage 20, and also showing the secondary lock 22 in its fully installed position. The contact has a shoulder part or flange 60 with a rearwardly-facing shoulder 62 that lies immediately forward (a small distance forward) of abutting ends 64 of the tines 54. The contact has a rear portion 66 that is crimped to the wire 18, with the wire extending rearwardly through a passage portion 68 in the grommet 46.

Figure 7:
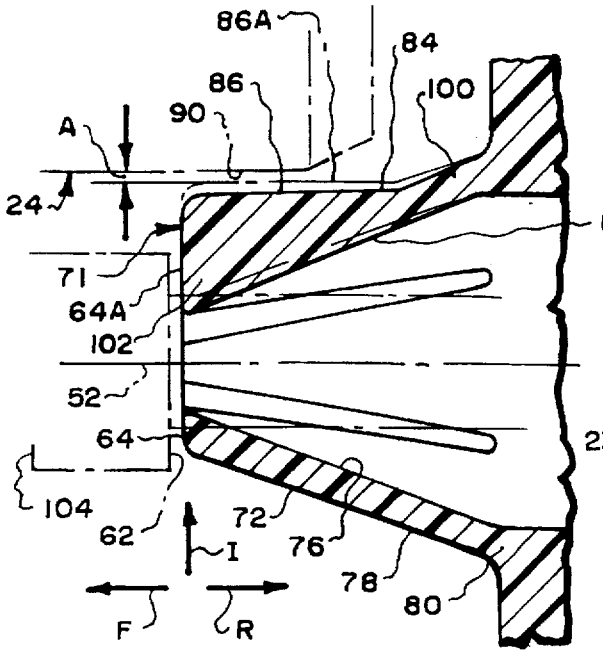
FIG. 7 is an enlarged view of a portion of the connector of FIG. 6, with the tines shown at positions assumed prior to contact installation.
Figure 8:
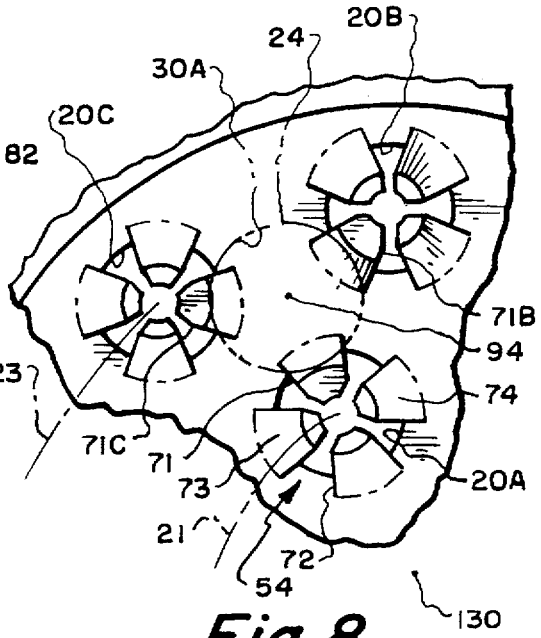
FIG. 8 is a view taken on line 8—8 of FIG. 3.
Figure 10:
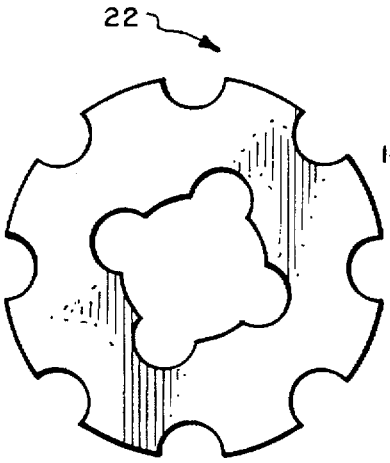
FIG. 10 is a front elevation view of the secondary lock of FIG. 9.

As indicated in FIG. 8, each set 54 of tines includes four tines 71–74. The first tine 71 is different from the other three tines 72–74. As shown in FIG. 7, the second tine 72 (and the tines 73, 74) has radially inner and outer tine sides 76, 78, with the radial direction being with respect to the passage axis 52. The radially inner and outer sides 76, 78 are both substantially straight and extend with forward F and radially inward I (towards the axis 52) directional components from a mounted rear end 80 of the tine, to the free, or abutting end 64 of the tine. The abutting end 64 lies close to the contact retention shoulder 62 and in line with it (in a direction parallel to axis 52) to prevent the shoulder from moving rearwardly by more than a small amount (a small amount is permissible when connectors mate).

The first tine 71 of the set has a radially inner tine side 82 of the same shape and orientation as the inner sides of the other tines. However, the first tine 71 has a radially outer surface 84 with a surface forward portion 86 that extends substantially parallel to the passage axis 52. A corresponding secondary lock post 24 has a blocking part 90 that lies close to the outer surface portion 86 to limit radially outward deflection of the first tine by an amount that would cause the first tine abutting end 64A to move out of line with (i.e. axially rearward of) the contact shoulder 62.

When the contact 16 is installed, it deflects the tines, so in the fully installed position of the contact the front outer surface portion 86 of the first tine is slightly deflected to the position 86A. The blocking portion 90 of the post is still spaced a distance A from the first tine, but prevents a much further radially outward deflection of the first tine. The distance A is provided so the post can be slid rearwardly to the final position, without damaging the first tine 71. It is possible for a post blocking portion 90 to lightly engage the tine surface at 86A, but because of manufacturing tolerances a slight gap A of an average of more than one thousandth inch is usually provided.

FIG. 6 shows the set of tines 54 with the contact fully installed, and with the first tine forward outer surface 86A slightly spaced from the locking portion 90 of the post 24. It may be noted that prior to insertion of the post 24 and during forward installation of the contact 16, the tines will be radially outward deflected by a considerable amount, with the first tine being deflected so its forward radially outer surface is deflected to the position 86B. Resilience of the tines causes them to move radially inwardly after the shoulder has passed, and they are intended to bear against the rear portion 66 of the contact.

The post 24 is of substantially cylindrical shape, at least at a rear portion 92, or at least the blocking portions 90 extend substantially parallel to the axis 94 of the post-receiving hole 30. As a result, the amount of first tine deflection allowed by the post is determined only by the diameter of its rear portion, rather than by the depth of rearward movement of the post during its installation. The radially outer surface 86A of the first tine is preferably constructed so it extends substantially parallel to the passage axis 52 in the fully installed position of the contacts, which makes accurate manufacture easier.

As shown in FIG. 7, the first tine has a thin bendable rear portion 100 where most of the tine bending occurs, and the tine forward portion 102 is of increased thickness. The forward portion 102 has a maximum radial thickness that is preferably at least twice as great as the rear portion 100. It is possible to provide only a thick rib portion at the tine forward portion 102, although applicant prefers to thicken the entire width of the forward portion. It also would be possible to provide a bump of small axial length instead of the axially extending surface 86, but it would be more difficult to maintain the tolerance of such a bump. The other tines such as 72 are preferably of constant thickness along their lengths.

The front end 64A of the first tine is shown as extends substantially no further forward than the abutting surfaces 64, 64A of the tines; the outer surface 86 of the first tine preferably extends no further forward than the front 104 of the contact flange 60. This helps control the radial position of the first tine outer surface 86. The contact flange 60 has a length about equal to the diameter of the contact immediately behind the shoulder 62.

FIG. 4 shows the twelve contact-receiving passages 20 arranged in groups of three each, around each of four post-receiving holes 30A –30D. Three contact-receiving passages 20A–20C and corresponding sets of tines, are arranged symmetrically about a group axis 94 and about each post-receiving hole 30A which extends along the axis 94. One passage 20A lies on the inner circle 21 and two passages 20B, 20C lie on the outer circle 23. As shown in FIG. 8, the first tine 71, 71 B, 71C of each set lies adjacent to a post-receiving hole 30A, and therefore to the post lying therein. This allows the post 24 to provide a secondary lock for the first tine of each of three contact-receiving passages 20A–20C. The fact that the rearward end of each post 24 is substantially cylindrical, permits easy manufacture of the posts and installation of the posts without regard as to which post is received in which post-receiving hole.

FIG. 2 shows that the secondary lock 22 includes four posts 24 that extend rearwardly from the plate-like holder 26. The holder 26 has a central hole 110 with scallop-shaped cutouts 112, and has a periphery 114 with similar scallop-shaped cutouts 116. The cutouts 112 at the walls of the central hole 110 avoid blocking the contact-receiving passages 20 and the contacts therein, while the cutouts 116 at the outer periphery of the holder serve the same purpose. The insulator 40 has a recess 120 in its front face that receives the plate-like holder 26, so the forward face 122 of the holder lies substantially flush with the front 124 of the insulator where the front 126 of the contact-receiving passages lie. The front 126 of the passages forming lead-in guides for pins that engage the sockets of the contacts. The holder 26 and posts 24 are symmetrically arranged about an axis which is coincident with the axis 130 of the connector. As a result, it does not matter as to which of the posts 24 are received in which of the post-receiving holes 30.

Figure 9:
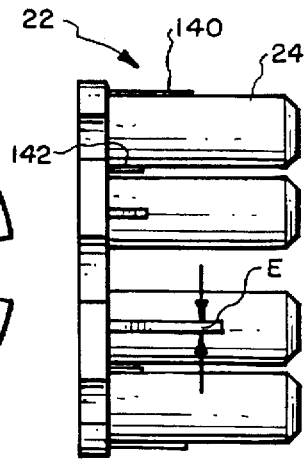
FIG. 9 is a side elevation view of the secondary lock of FIG. 2.
Figure 11:
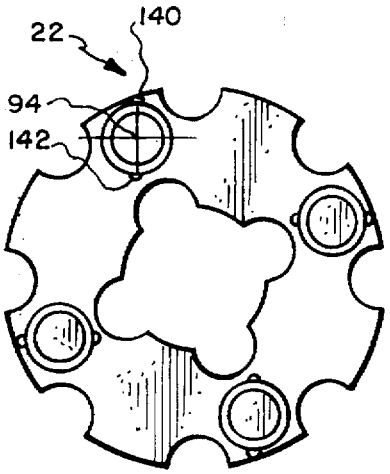
FIG. 11 is a rear elevation view of the secondary lock of FIG. 9.

FIG. 9 shows that although each post 24 is of substantially cylindrical shape, each post is provided with a long rib 140 and a short rib 142. Applicant commonly manufactures all of a connector except for contacts, and ships them to a customer who installs the contacts. In order to reduce the number of loose parts and avoid confusion on the part of the customer as to the orientation at which the secondary lock must be installed (it doesn't matter but the customer may not remember this), applicant prefers to partially install the secondary lock to an intermediate position.

Figure 12:
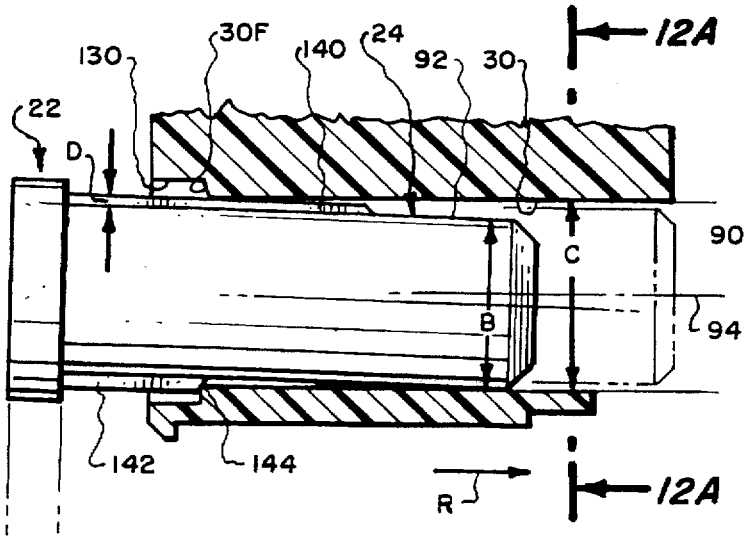
FIG. 12 is a view of a portion of the connector of FIG. 6, with the secondary lock at an intermediate position.
Figure 12A:
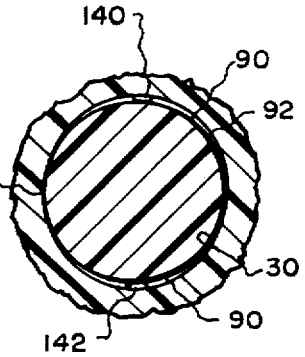
FIG. 12A is a sectional view taken on line 12A—12A of FIG. 12, with the secondary lock in his fully installed position.

FIG. 12 shows the secondary lock 22 in its intermediate position. Most of each post 24 is of cylindrical shape, with a diameter B that is substantially the same or only slightly smaller than the diameter C of the hole in which it fits, so the rear portion 92 of the post is accurately positioned with respect to the walls of the post-receiving hole 30 near its rear end. When the long rib 140 lies in the cylindrical post-receiving hole 30, it results in a moderate interference fit, which assures that the secondary lock will not fall out or be accidentally removed. When the short rib 142 also lies in the post-receiving hole 30, this results in a large interference fit, which assures that the secondary lock will not be removed unless a tool is applied to force it out so that a contact can be removed. Applicant prefers to initially install the secondary lock 22 so the long rib 140 lies in the hole 30, but the front end 144 of the short rib lie at the front end 30F of the hole 30. This can be easily accomplished by pushing the secondary lock 22 rearwardly with a moderate force. When the customer receives the connector with the secondary lock in its intermediate position, the customer installs the contact and then forces the secondary lock 22 to its fully installed position, wherein the post reaches the position shown in phantom lines in FIG. 12.

When the secondary lock 22 is pushed rearwardly to its fully installed position, a high resistance to such full installation indicates that one of the contacts has not been fully installed. That is, the resistance indicates that one of the first tines is at the position shown in FIG. 6 at 86B wherein it blocks the post.

A connector of the illustrated construction that applicant has designed has an overall length A (FIG. 3) of 1.05 inch and other dimensions proportional to those illustrated. Each post has a diameter B (FIG. 12) of 0.140 inch (±0.002 inch) while each post-receiving hole has a diameter C of about 0.142 inch, so the rearward portion of each post is closely controlled in radial position by the walls of the post-receiving hole. Each rib 140, 144 has a radial height D of 0.009 inch, so that when only the long rib 140 lies in a post-receiving hole, there is an interference of about 0.007 inch, while when both posts 140, 142 lie in a hole there is an interference fit of about 0.016 inch. The ribs each have a relatively small width E (FIG. 9) such as 0.020 inch.

Thus, the invention provides a connector and a secondary lock for preventing contact-locking tines from releasing a contact of the connector, where the connector can be constructed of small size despite having many contacts and the secondary lock can be easily constructed and installed and reliably locks a tins in place at each contact. A first tins lying beside a contact-receiving passage, has a radially thick forward portion. The secondary lock includes a post that can slide into a post-receiving hole in the connector, so a blocking part of the post extends substantially parallel to the contact-receiving passage. The blocking part of the post preferably lies slightly spaced from the radially outer side of the first tine. This avoids requiring the post to deflect the tine, but instead allows the post to only lie beside the tine and prevent excess tine deflection. The post preferably has a plurality of blocking portions such as three of them, which each lies beside a first tine of a different contact-receiving passage. The rear portion of the post is preferably cylindrical so it can be constructed at low cost and accurately guided by a simple cylindrical post-receiving hole, to a position where each blocking part of the post lies adjacent to a first tine of a different contact-receiving passage. The secondary lock preferably includes a plurality of posts with forward ends held by a plate-like holder that has a central hole and that has cutouts in its periphery and preferably also in its central hole, to avoid blocking areas immediately in front of the contact-receiving passages. The outer surface of each post is preferably substantially cylindrical, but with long and short ribs. The long rib providing a moderate interference fit to hold the secondary lock during shipment to a customer, and the long and short ribs together forming a large interference fit to hold the posts in their fully inserted positions.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector which has an insulator with a plurality of contact-receiving passages having substantially parallel passage axes extending in forward and rearward directions, a plurality of electrical contacts that are each slidable in said forward direction into one of said passages and that each has a shoulder part forming a shoulder that faces largely in said rearward direction, said connector including tines that each has an abutting part that lies in an abutting position in line with the shoulder of one of said contacts to prevent rearward movement of a fully installed contact but with the tine abutting part being deflectable to allow the shoulder part to pass rearwardly of the tine, and a secondary lock that is installable in said insulator after a first of said contacts is installed in a first of said passages, said secondary lock having a first post that blocks deflection of a first of said tines to prevent its abutting part from moving out of said abutting position, characterized by:

said first tine has radially inner and outer tine sides;

said post is slidable substantially parallel to a first axis of said first passage and said post has a blocking part that lies adjacent to but substantially out of contact with said outer tine side to not deflect said first tine but to only limit radially outward movement of said first tine.

2. The connector described in claim 1 wherein:

said first tine has a thin bendable rear portion, and said first tine has a radially thicker front portion with a maximum radial thickness at least twice the thickness of said thin rear portion.

3. The connector described in claim 1 wherein:

said first tine radially outer side extends forwardly substantially no further than said abutting part.

4. The connector described in claim 1 wherein:

said outer tine side has a forward portion that extends substantially parallel to said first passage axis.

5. The connector described in claim 1 wherein:

said plurality of contact-receiving passages are arranged in at least two concentric passage circles and said passages form a plurality of groups of three passages that are equally distant from a group axis that extends parallel to said passage axis;

said insulator has a plurality of separate post-receiving holes that each extends along one of said group axes, with each post having a blocking part lying adjacent to a tine at each passage of a group of three passages.

6. The connector described in claim 5 wherein:

said secondary lock includes a largely plate-like holder and a plurality of posts, including said first post, mounted on said holder;

said holder extending substantially in a holder circle that is concentric with said passage circles, and said holder has a central hole to avoid blocking areas immediately in front of at least some of said contact-receiving passages.

7. The connector described in claim 5 wherein:

said insulator has a front end with a recess that closely receives said plate-like holder.

8. The connector described in claim 6 wherein:

said holder has a periphery with a plurality of cutouts therein to avoid blocking areas immediately in front of said passages.

9. The connector described in claim 1 wherein:

said insulator has a post-receiving hole with hole walls that are substantially cylindrical, and said post has a cylindrical portion that fits closely in said hole and has a pair of ribs at largely opposite sides of the post that are formed to have an interference fit with the walls of the hole, with a first of said ribs being longer than the second of said ribs.

10. A connector for holding a plurality of contacts that each has a rearwardly-facing shoulder, comprising:

an insulator which has a plurality of contact-receiving passages with parallel passage axes that extend in forward and rearward directions for receiving contacts, a plurality of resilient tines around each of said passages with said tines each extending generally forwardly and with a radially inward directional component toward a corresponding passage axis, with said contacts each being installable into one of said passages by insertion of the contact in a forward direction therein until a plurality of tines around the passage snap to a position immediately behind said shoulder;

said contact receiving passages are arranged in a plurality of concentric circles including an inner circle and an outer circle, and at least some of said passages are arranged in a plurality of groups that each includes at least three passages clustered around a group axes, including two passages lying on said outer circle and one passage lying on said inner circle, and said insulator has a post-receiving hole extending along each of said group axes; and a secondary lock which includes a holder and a plurality of posts extending rearwardly from said holder, each post having three blocking parts with each blocking part lying adjacent to a tine of a different passage of a group of passages to prevent the tine from deflecting away from a position directly rearward of the shoulder of a corresponding contact.

11. The connector described in claim 10 wherein:

said tines are formed with a first tine of each plurality of tines that lie around a passage, having a thin and bendable rear portion and a thicker front portion with an outer surface, each of said contacts has a rear part lying immediately rearward of the contact shoulder with said first tine pressing radially inwardly against said contact rear part, and said blocking parts of said posts extend substantially parallel to said passage axis and lie slightly radially spaced from the radially outer surface of the first line at each passage of the set when the first tine presses radially inwardly against a contact rear part.

12. The connector described in claim 10 wherein:

each of said posts has a rear end of cylindrical shape.

13. The connector described in claim 10 wherein:

said connector has an axis and said holder has a hole with hole walls extending around said connector axis.

14. A connector for holding a plurality of contacts that each have a rearwardly-facing shoulder, comprising:

an insulator which has a plurality of contact-receiving passages with parallel passage axes that extend in forward and rearward directions for receiving contacts, a plurality of resilient tines around each of said passages with said tines each extending generally forwardly and with a radially inward directional component toward a corresponding passage axis, with said contacts being installable into one of said passages by insertion of the contact in a forward direction therein until a plurality of tines around the passage snap to a position immediately behind said shoulder;

said insulator has a post-receiving hole lying adjacent to a first of said passages and extending rearwardly from a front end of said insulator;

a secondary lock which includes a post having a blocking part adjacent to a first tine that lies around said first passage, to limit deflection of said first tine away from the axis of said first passage;

said post having a largely cylindrical portion that fits closely in said post-receiving hole, and having a pair of ribs that are formed to have an interference fit with the walls of the hole, with a first of said ribs extending further rearward than the second of said ribs wherein when the second of said ribs lies in said hole the interference fit is larger.

15. The connector described in claim 14 wherein:

said ribs are positioned so when said first rib lies in said post-receiving hole, but a rear end of said second rib lies at said front end of said insulator, said post blocking part does not lie sufficiently rearward to limit deflection of said first tine, but when said second rib lies substantially fully in said hole said post blocking part limits deflection of said first tine.

* * * * *